US005193698A

United States Patent [19]

Koizumi

[11] Patent Number: 5,193,698

[45] Date of Patent: Mar. 16, 1993

[54] JIB STRETCHING AND FOLDING DEVICE FOR USE IN A CRANE

[75] Inventor: Yukio Koizumi, Kakogawa, Japan

[73] Assignee: Kabushiki Kaisha Kobe Seiko Sho, Kobe, Japan

[21] Appl. No.: 883,194

[22] Filed: May 14, 1992

Related U.S. Application Data

[63] Continuation-in-part of Ser. No. 758,586, Sep. 12, 1991.

[30] Foreign Application Priority Data

Sep. 13, 1990 [JP] Japan ..... 2-245069

[51] Int. Cl.[5] ..... B66C 23/42

[52] U.S. Cl. ..... 212/168; 212/188; 212/266

[58] Field of Search ..... 212/168, 187, 188, 261, 212/182, 266

[56] References Cited

U.S. PATENT DOCUMENTS 4,828,124 5/1989 Iga ..... 212/188
4,953,724 9/1990 Kaizumi ..... 212/266

*Primary Examiner*—Sherman Basinger
*Assistant Examiner*—Thomas J. Brahan
*Attorney, Agent, or Firm*—Oblon, Spivak, McClelland, Maier & Neustadt

[57] ABSTRACT

A jib stretching and folding device is used in a crane having a jib for increasing a lift of the crane, the jib being stretchable from a folded position along a side surface or a lower surface of a boom through a vertically suspended position. The jib stretching and folding device has a jib maneuvering cylinder, an engaging portion formed in a piston rod of the cylinder, an engaging member provided on the jib, and a guide surface formed at at least either of the engaging portion or the engaging member for guiding the engaging member so as to engage with the engaging portion. The jib is made movable between the vertically suspended position and the folded position by way of extension and contraction of the piston rod.

5 Claims, 9 Drawing Sheets

JIB STRETCHING AND FOLDING DEVICE FOR USE IN A CRANE

This application is a continuation-in-part of Ser. No. 758,586 filed Sep. 12, 1991, pending.

BACKGROUND OF THE INVENTION AND RELATED ART STATEMENT

The present invention relates to a jib stretching and folding device for use in a jib down-folding type crane or a jib side-folding type crane.

Referring now to FIG. 8 showing a conventional jib side-folding type crane which holds a folded jib 2 having left and right beams (the terms "left" and "right" will be hereinafter defined as direction as viewed from an operator cab under the stretched position of the jib) on one lateral side of a telescopic boom 1 with the left and the right beams vertically aligned (upright posture,) the jib 2 can be stretched through the following three steps:

1) Swinging-down step in which, with a base end of the left beam of the jib 2 being rotatably connected on a horizontal shaft (one-side jib mounting shaft) 11 provided on the left side surface of a forward end portion of the boom, the jib 2 is swung down away from a base portion of the boom 1 about the horizontal shaft 11 from a folded position shown by phantom lines to a vertically suspended position shown by solid lines. The horizontal shaft 11 is provided at each of opposite side surfaces of the forward end portion of the boom 1, both horizontal shafts 11 extending horizontally from the opposite side surfaces of the boom 1 in opposite directions;

2) Twisting step in which the vertically suspended jib 2 is twisted in a direction of an arrow A with respect to an axial direction of the left beam of the jib 2; and 3) Swinging-up step in which the twisted jib 2 is swung up from the vertically suspended position to a position where the jib 2 is stretched out forwardly from the forward end portion of the boom 1.

The jib 2 can be returned from its stretched position to its folded position along the one side surface of the boom 1 in the reverse order of the above.

On the other hand, as shown in FIG. 9, in a jib down-folding type crane which holds a folded jib 2 having a left and a right beams on a lower surface of a telescopic boom 1 with the left and the right beams horizontally arranged (horizontal posture) 6, the jib 2 can be stretched out through the following two steps:

1) Swinging-down step in which, with base ends of the right and the left beams of the jib 2 rotatably connected on horizontal shafts (two-side jib mounting shaft) 11 on the opposite side surfaces of a forward end portion of the boom 1, the jib 2 is swung down away from a base portion of the boom 1 about the horizontal shafts 11 from a folded position shown by phantom lines to a vertically suspended position shown by solid lines. The horizontal shaft 11 is provided at each of opposite side surfaces of the forward end portion of the boom 1, both horizontal shafts 11 extending horizontally from the opposite side surfaces of the boom 1 in opposite directions; and 2) Swinging-up step in which the vertically suspended jib 2 is swung up from the vertically suspended position to a position where the jib 2 is stretched out forwardly from the forward end portion of the boom 1.

The jib 2 can be returned from its stretched position to its folded position along the lower surface of the boom 1 in the reverse order of the above.

As steps commonly required in both the jib side-folding type crane and the jib down-folding type crane, there are the jib swinging-down step in which the jib 2 is moved from its folded position to its vertically suspended position in the stretching operation, and the jib hauling step in which the jib 2 is hauled from its vertically suspended position to its folded position.

As means for swinging down and hauling a jib, there has been conventionally used an auxiliary hoist wire rope (hereinafter referred to merely as a rope) 3 drawn out from an unillustrated winch provided on a crane main body in the following manner. The rope 3 is reeved from the forward end portion of the boom 1 through the forward end portion of the jib 2 to the base portion of the boom 1. The rope 3 may be reeved back from the base portion of the boom 1 to the forward end portion of the jib 2. The jib 2 can be swung down away from the base portion of the boom 1 or hauled thereto by unwinding or winding the rope 3.

However, the use of the conventional means for swinging down and hauling the jib invariably necessitates a series of cumbersome operations as follows:

a) to reeve the rope 3 a long distance along the boom 1 and the jib 2;

b) to engage and disengage an auxiliary hook with and from a free end of the rope 3 each time the crane operation is started or finished; and c) to handle the rope 3 after the jib 2 is swung down or hauled.

Accordingly, it has been taking a great deal of work and time to stretch and fold the jib 2, resulting in exceedingly low working efficiency.

SUMMARY OF THE INVENTION

In view of the foregoing defects of the prior art devices, it is an object of the present invention to provide a jib stretching and folding device for a crane which is capable of swinging-down and hauling a jib easily and rapidly by way of extension and contraction of a remotely controllable cylinder.

According to the present invention, a jib stretching and folding device for use in a crane including a telescopic boom having a forward end portion, a jib having a base end portion, the base end of the jib being connected to a forward end portion of the boom, the jib being movable between a stretched position where the jib is stretched out from the forward end portion of the boom and a folded position along either one side surface or a lower surface of the boom through an intermediate step of putting the jib into a vertically suspended position about a connection point of the base end portion of the jib and the forward end portion of the boom;

the jib stretching and folding device comprising:

(I) a jib maneuvering cylinder having an extendible actuating member, the cylinder being mounted on the boom in such a manner that the extendible actuating member projects outward from the lower surface of the boom when the extendible actuating member is extended;

(II) an engaging portion proivided in the extendible actuating member of the jib maneuvering cylinder;

(III) an engaging member engageable with the engaging portion in a lengthwise direction of the jib;

(IV) a guide surface formed at at least on of the engaging member and the engaging portion for guiding the engaging member in such a direction as to engage with the engaging portion when the jib is in the vertically suspended position and the jib maneuvering cylinder is in an extended state in a jib folding operation.

With the above construction, when the jib is to be hauled toward the boom in the jib folding operation, the jib maneuvering cylinder is actuated to extend with the jib being in the vertically suspended position. Thereby, the engaging portion provided at the extendible actuating member and the engaging member provided at the jib are guided along the guide surface to engage with each other. The jib maneuvering cylinder is actuated to contract in this state, whereby the jib can be hauled to the folded position along the side surface or the lower surface of the boom.

On the other hand, in the jib stretching operation, the maneuvering cylinder is actuated to extend with being connected to the jib, whereby the jib can be swung down from the folded position to the vertically suspended position. With being vertically suspended, the jib is moved in a lengthwise direction thereof by, for example, extending the boom. This causes the engaging member provided at the jib to automatically disengage from the engaging portion provided at the jib maneuvering cylinder. Thereby, the fixation of the jib maneuvering cylinder and the jib is released, making it possible to proceed to a subsequent step in the jib stretching operation.

The above and other objects, features and advantages of the present invention will become more apparent upon a reading of the following detailed description and the accompanying drawings.

DETAILED DESCRIPTION OF PREFERRED EMBODIMENTS OF THE INVENTION

Figure 1:
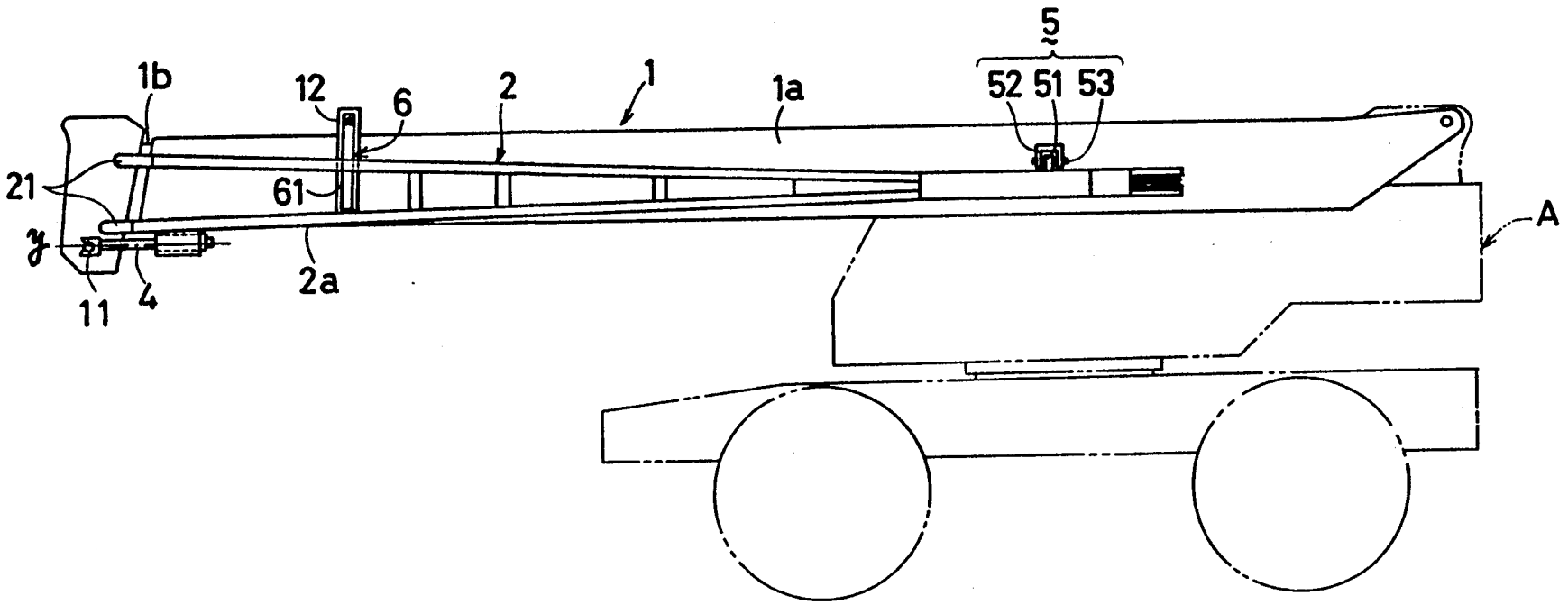
FIG. 1 is a schematic side view showing a crane provided with a jib stretching and folding device embodying the present invention in a jib folded state along a side surface of a fixed boom as a first embodiment.

A first embodiment of the present invention will be described with reference to FIGS. 1 to 4.

In this embodiment, the invention is incorporated into a jib side-folding type crane. Further, there is illustrated a single stage telescopic boom 1 constructed of a fixed boom 1*a* rotatably connected to a crane main body A and single stage movable boom 1*b*.

Indicated at 2 is a jib provided with forked jib feet 21, 21 on opposite sides of a base end thereof. The jib 2 has two beams. The beam positioned lower than the other in an upright posture when the jib 2 is folded is a main beam 2*a*. To the main beam 2*a* is mounted a connecting member 4 rotatably about an axis y of the connecting member 4 and slidably along an axial direction thereof.

Figure 2:
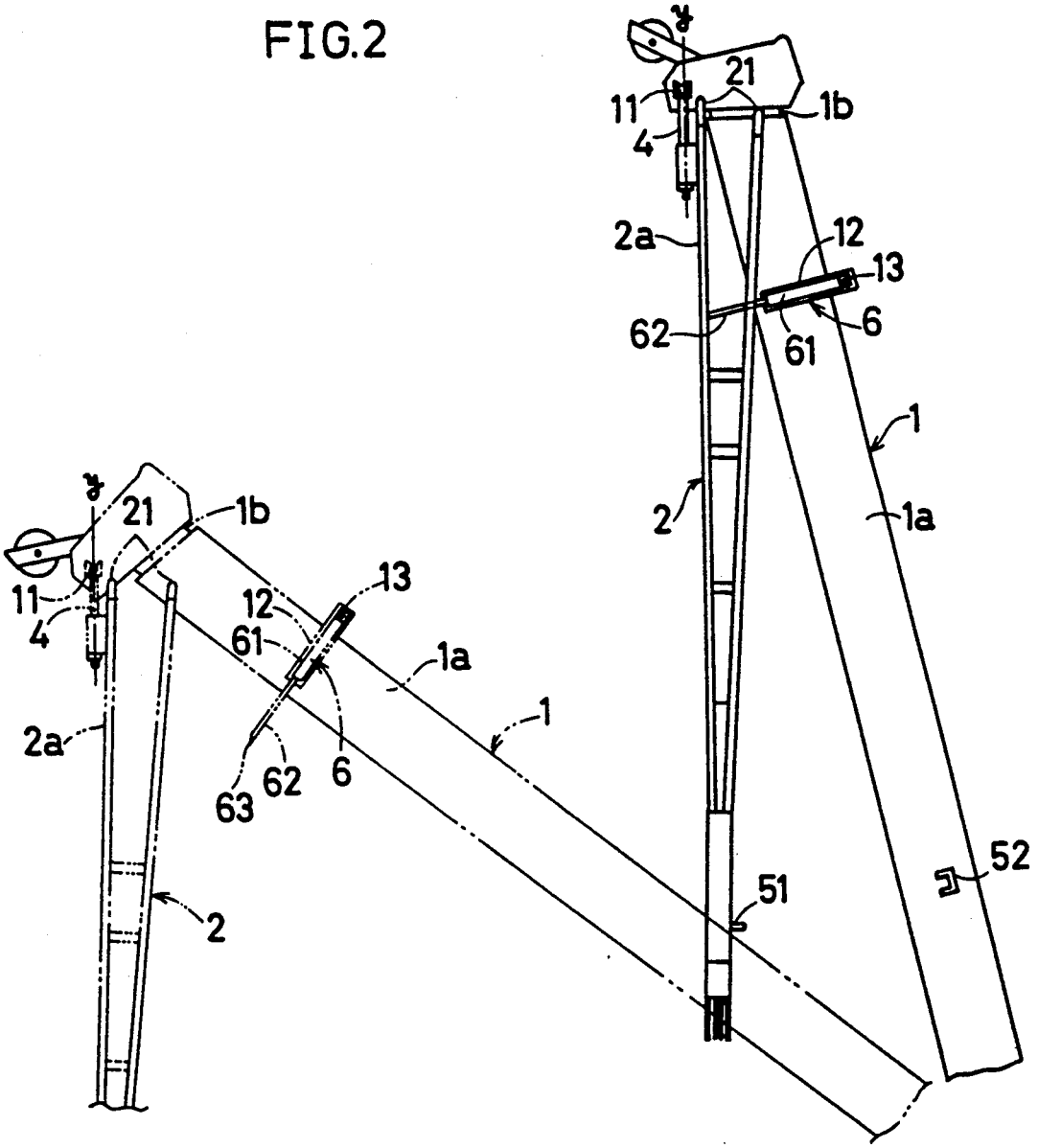
FIG. 2 is a schematic side view showing the jib and a boom when the jib is in a vertically suspended position.

With the connecting member 4 rotatably connected to a jib mounting shaft 11 provided on a left side surface of the boom 1, the jib 2 is stretched out forwardly from a forward end portion of the boom 1 through the following steps, the connection point of the boom 1 and the jib 2 serving as a supporting point:

1) Swinging-down step in which the jib 2 is swung down from a folded position along the left side surface of the boom 1 shown in FIG. 1 to a vertically suspended position shown in solid lines in FIG. 2;

2) Twisting step in which the vertically suspended jib 2 is twisted about the axis y of the connecting member 4;

3) Lifting step in which the twisted jib 2 is lifted in the vertical direction until both jib feet 21, 21 are connected to the jib mounting shafts 11 on opposite side surfaces of the forward end portion of the boom 1;

4) Swinging-up step in which the lifted jib 2 is swung up forward.

The jib 2 can be returned from the stretched position to the folded position along the left side surface in the reverse order of the above.

The jib 2 is fixed to the fixed boom 1*a* by means of a jib fixing mechanism 5. The jib fixing mechanism 5 comprises brackets 51, 52 respectively provided at a forward end portion of the jib 2 and at the fixed boom 1*a*, and a connecting pin 53 for connecting the brackets 51, 52 to each other.

Next, there will be described a mechanism for swinging down and hauling the jib 2 respectively in the jib stretching operation and the jib folding operation.

A cylinder mounting frame 12 is secured to the left side surface of the forward end portion of the fixed boom 1*a* in a direction perpendicular to an axial direction of the boom 1. To the cylinder mounting frame 12 is mounted a jib maneuvering cylinder 6.

Figure 3:
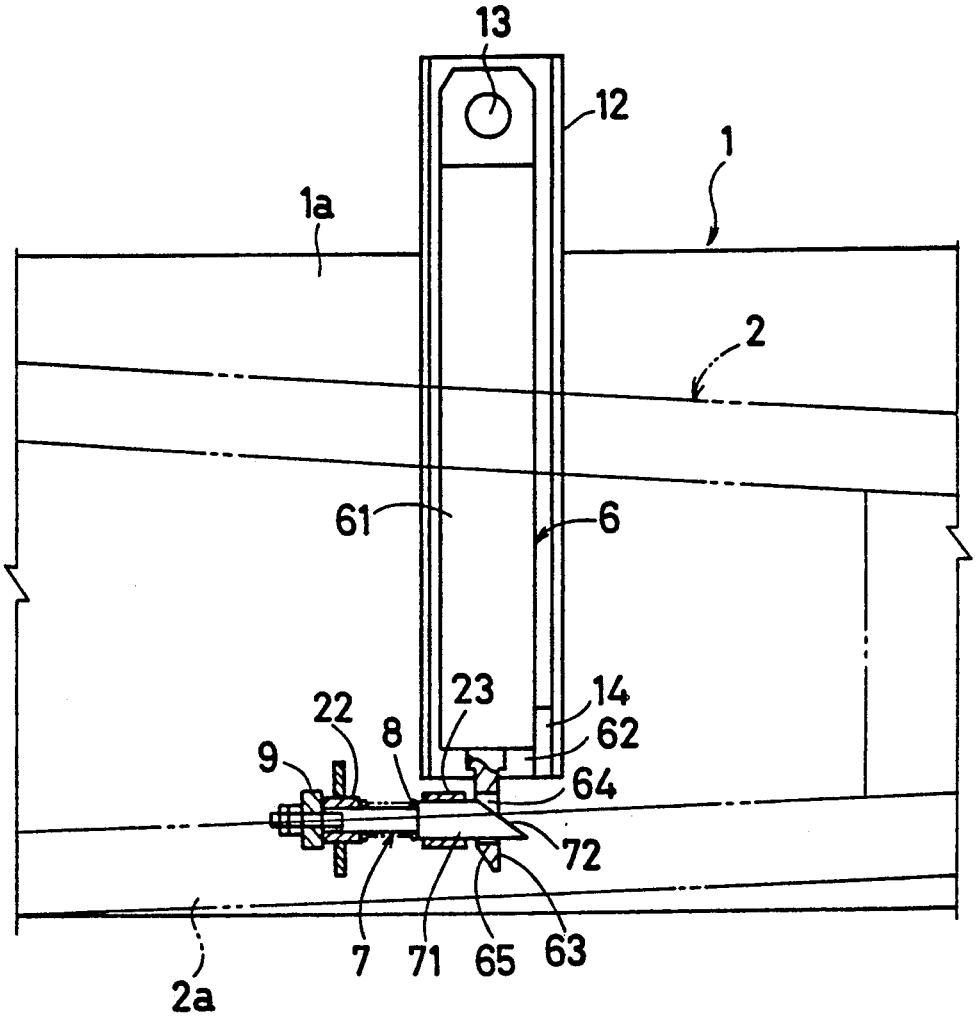
FIG. 3 is a diagram enlargedly showing the jib stretching and folding device when the jib is in a folded position.
Figure 4:
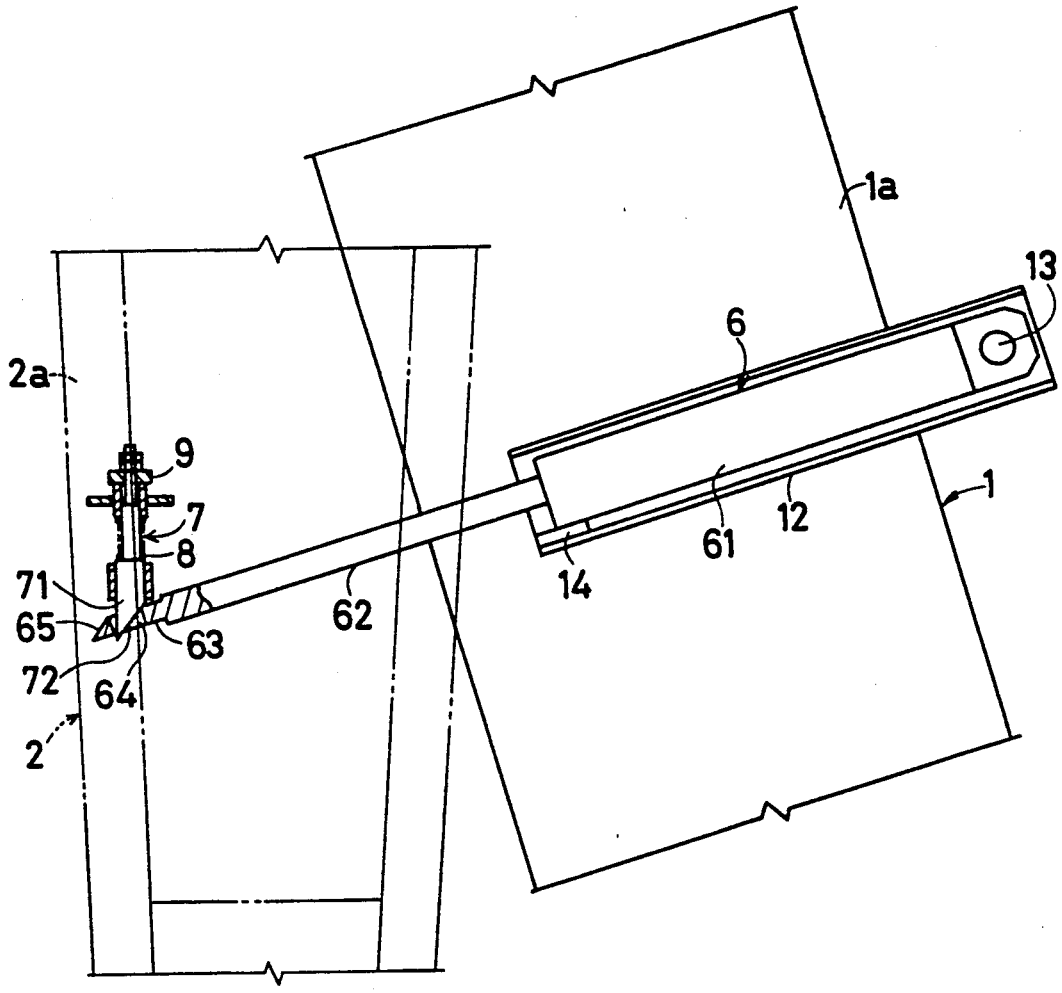
FIG. 4, which is equivalent to FIG. 3, is a diagram enlargedly showing the jib stretching and folding device when the jib is in the vertically suspended position.

The jib maneuvering cylinder 6 is, as enlargedly shown in FIGS. 3 and 4, mounted to the mounting frame 12 in such a manner that a cylinder tube extends in a vertical direction when the boom 1 is maintained horizontally. A base end (an upper end in the figures) of the cylinder tube 61 is rotatably connected to the cylinder mounting frame 12 through a pin 13 extending in a widthwise direction of the boom 1. As shown in FIGS. 2, 4, when the jib maneuvering cylinder 6 is actuated to extend, a rod 62 serving as an extendible actuating member projects outward of the lower surface of the boom 1. Indicated at 14 is a cylinder guide member fixed to the cylinder mounting frame 12.

Further, the rod 62 is provided with an engaging hole 64 (engaging portion) in a forward end portion 63 thereof. An axis of the engaging hole 64 is perpendicular to an axis of the rod 62.

On the other hand, on a base portion of the main beam 2*a* of the jib 2 is provided an engaging pin 7 serving as an engaging member and disengageably insertable into the engaging hole 64.

The engaging pin 7 is supported slidably along a line substantially parallel to the main beam 2*a* by pin guides 22, 23 disposed forward and rearward portions. The engaging pin 7 is also biased by a helical compression spring 8 in such a manner that the forward end 71 of the pin 7 facing toward the forward end of the jib 2 projects rearward from the rearward pin guide 23. Indicated at 9 is a stopper for regulating a rearward projection amount of the engaging pin 7.

The forward end portion 71 of the engaging pin 7 and the forward end portion 63 of the rod 62 included in the jib maneuvering cylinder 6 are respectively provided with oblique guide surfaces 72 and 65 so as to facilitate engagement of the pin 7 and the rod 62.

The jib maneuvering cylinder 6 is in a contracted state when the jib 2 is in the folded position as shown in FIG. 1. In this state, the forward end portion 71 of the engaging pin 7 is inserted into the hole 64 of the cylinder 6 as shown in FIG. 3, whereby the jib maneuvering cylinder 6 and jib 2 can be engageably connected to each other.

The jib swinging-down step from the above position and the jib hauling step in the jib folding operation are respectively carried out in the following manner.

With the boom 1 being completely contracted, the connecting member 4 of the jib 2 is connected to the jib mounting shaft 11 provided on the left side surfaces of the boom 1. In addition, the boom 1 is pivotally moved up to a maximum angled position thereof where the angle formed between the boom 1 and the ground surface is at maximum after the fixation of the jib 2 to the boom 1 by means of the jib fixing mechanism 5 is released.

In this state, the jib maneuvering cylinder 6 is actuated to extend by remote control from an operator's cab on the crane main body A. Thereby, the jib 2 is swung about the jib mounting shaft 11 with the connection point serving as a supporting point, consequently taking a vertically suspended position.

The jib 2 continuously receives a rotational force toward its vertically suspended position due to the weight thereof after the fixation of the jib 2 to the boom 1 by means of the jib fixing mechanism 5 is released. Accordingly, the jib maneuvering cylinder 6 serves to render the jib 2 smoothly swing down to the vertically suspended position while suppressing the rotational force of the jib 2.

When the jib 2 is in the vertically suspended position, the forward end of the jib 2 is located in a substantially high level from the ground, which deters a jib twisting operation to be executed in a subsequent step.

In view of this, the boom 1 is slightly extended so as to lift the jib 2, thereby disengaging the engaging pin 7 from the engaging hole 64. Thereafter, the boom 1 is pivotally moved downward as shown in phantom lines in FIG. 2. lowering the jib 2. In this case, the jib 2 is already in the vertically suspended position, which precludes the possibility that the jib 2 is swung in a great travel while the boom 1 is pivoted downward.

In the above fashion, the jib 2 can be swung down from the folded position into a position suitable for proceeding to the subsequent twisting step.

The jib 2 can be hauled to the folded position in the folding operation in the reverse of the foregoing swing-down step. More specifically, after pivotally moving up the boom 1 from the position shown in phantom line in FIG. 2 to the maximum angled position as shown in solid lines in FIG. 2, the jib maneuvering cylinder 6 is actuated to extend.

In this way, the forward end portion 63 of the rod 62 included in the cylinder 6 comes into contact with the forward end portion 71 of the engaging pin 7. The forward end portions 63, 71 are respectively guided along the guide surfaces 72, 65, and thereby the forward end portion 71 of the pin 7 is automatically inserted into the engaging hole 64 formed in the forward end portion 63 of the rod 62.

This causes the jib maneuvering cylinder 6 and the jib 2 to connect to each other. Accordingly, by contracting the cylinder 6 in the above state, the jib 2 can be hauled to the folded position thereof along the left side surface of the boom 1.

Thereafter, the boom 1 is pivotally moved down to the substantially horizontal position as shown in FIG. 1. The jib 2 is fixed in the folded position by means of the jib fixing mechanism 5, thereby completing the jib folding operation.

Next, a second embodiment of the invention will be described with reference to FIGS. 5 to 7.

In the second embodiment, the invention is incorporated into a jib down-folding type crane. Like or identical numerals designates like or identical parts in the first and second embodiments, and thereby description on the like or identical parts are omitted to avoid repetition.

Figure 5:
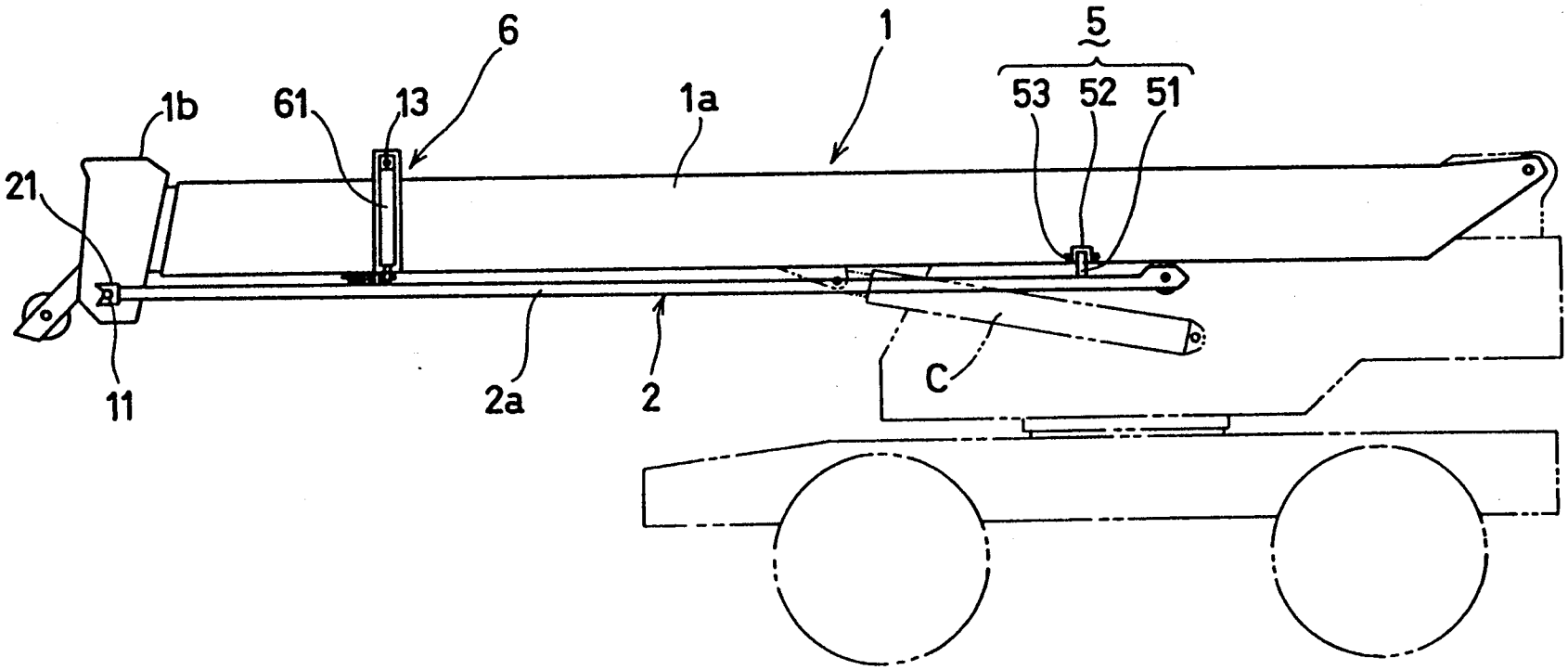
FIG. 5 is a schematic side view showing a crane provided with a jib stretching and folding device embodying the present invention in a jib folded state along a lower surface of a boom as a second embodiment.
Figure 6:
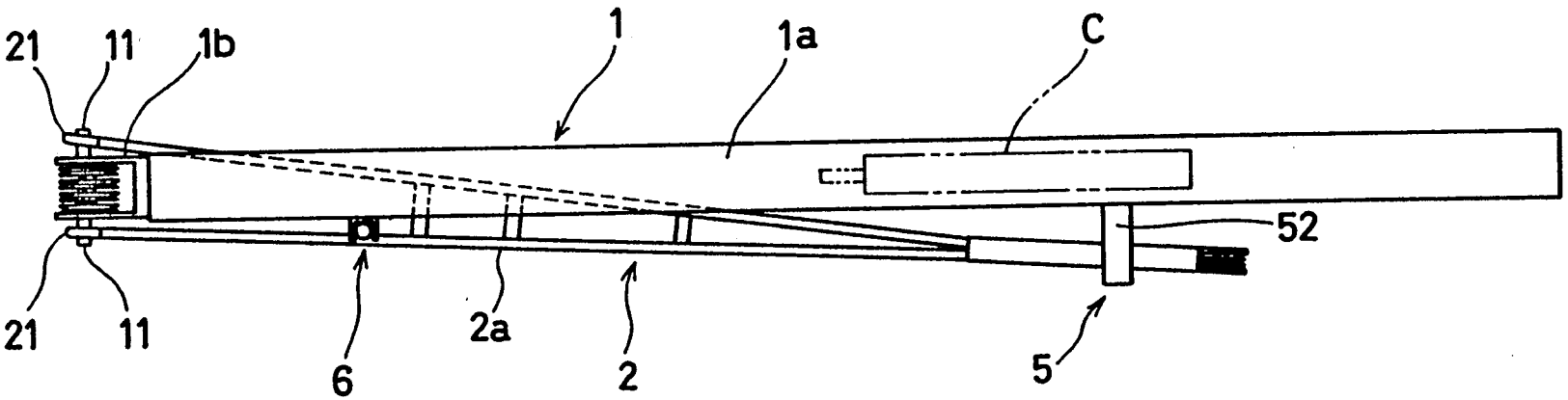
FIG. 6 is a plan view schematically showing a jib and the boom in a substantially jib folded state.
Figure 7:
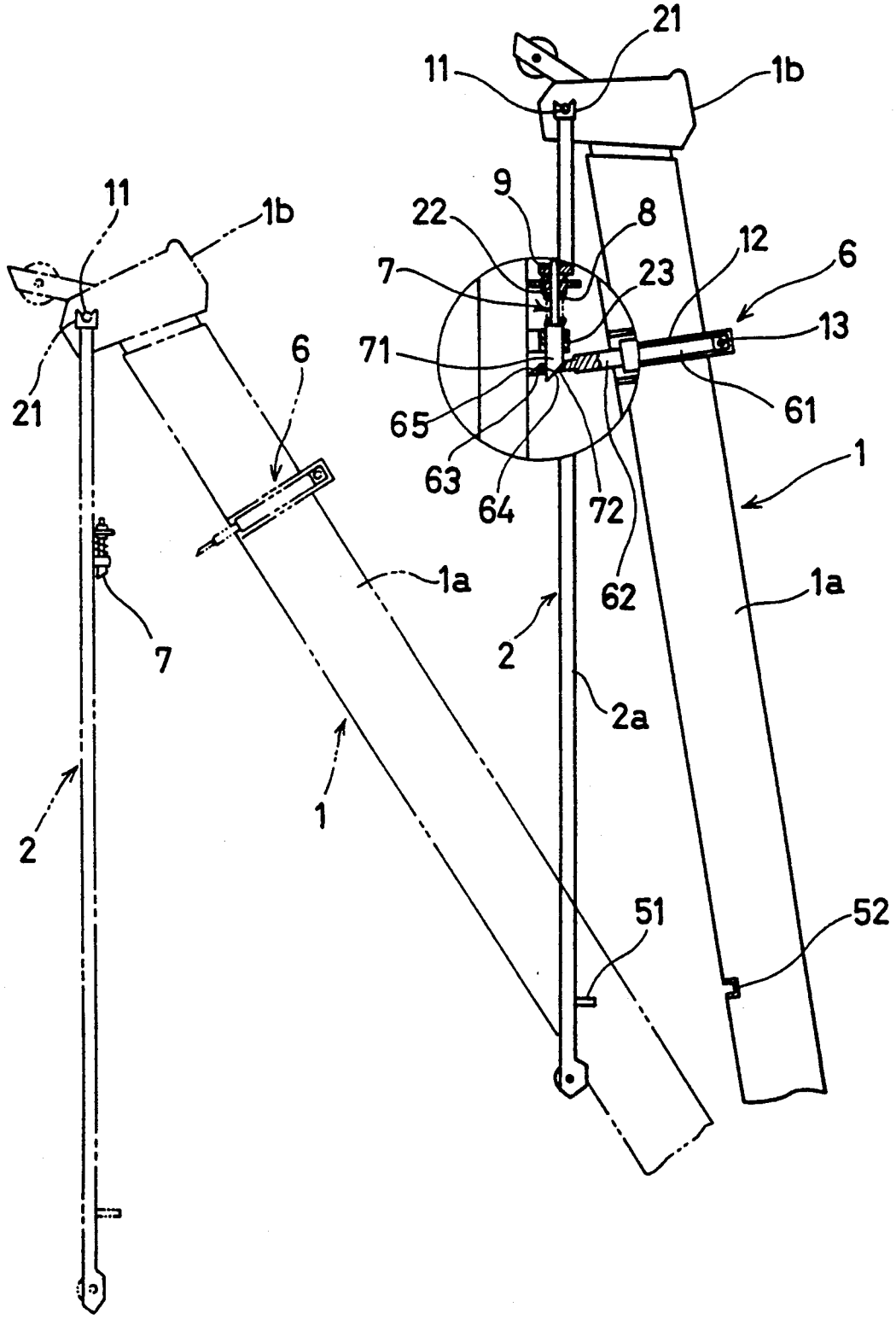
FIG. 7 is a schematic side view of the jib and boom in a suspended position with the jib stretching and folding device partially enlargedly shown.
Figure 8:
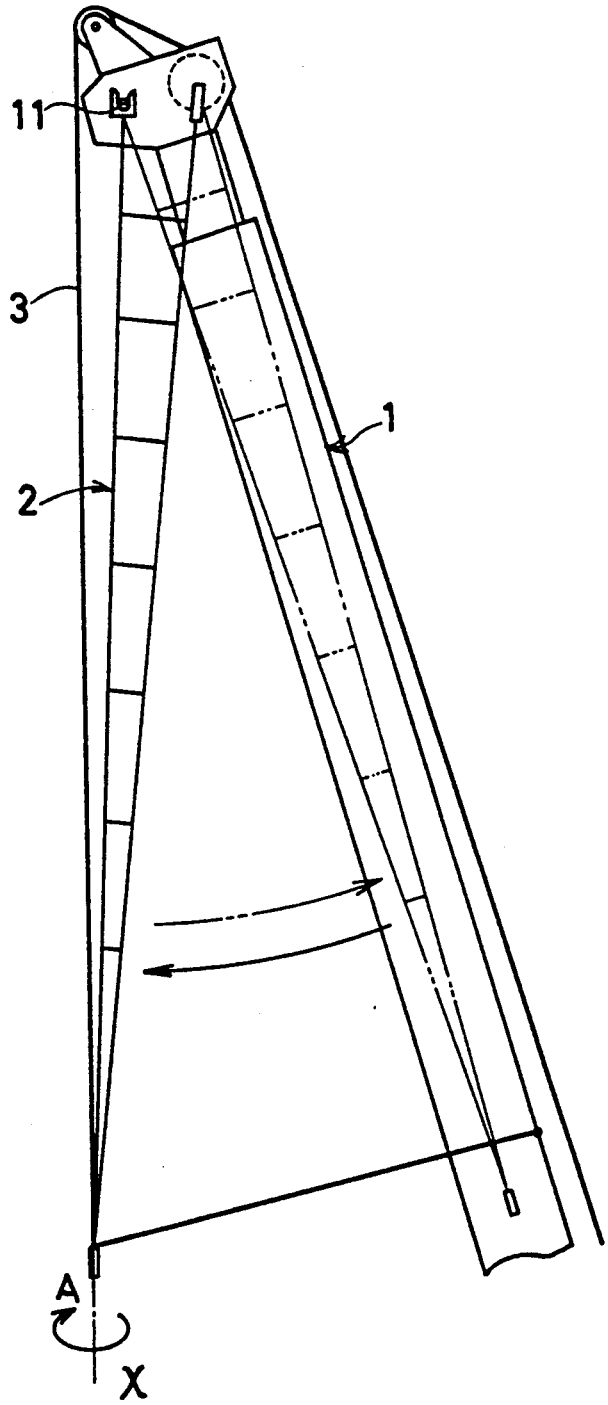
PRIOR ART FIG. 8
FIGS. 8 and 9 are schematic side views respectively showing means for swinging down and hauling the jib in prior art devices.
Figure 9:
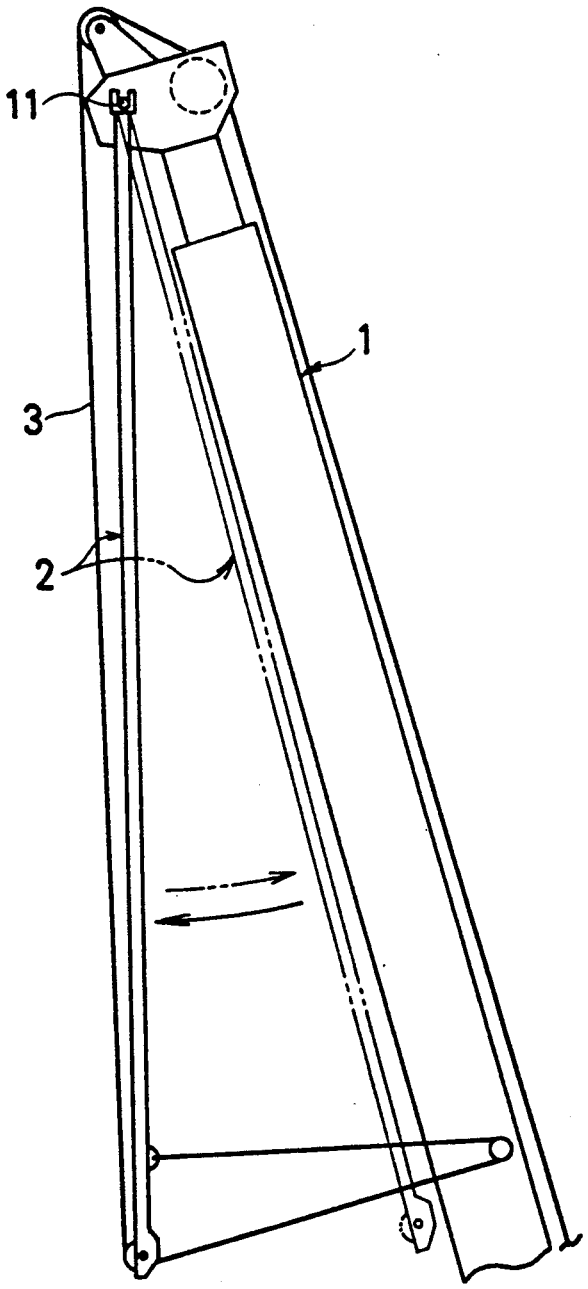
PRIOR ART FIG. 9

A jib 2, when not in use, is folded in a horizontal posture along a lower surface of a boom 1 as shown in FIGS. 5 and 6 so as to avoid interference with a boom derrick cylinder C. In the folded state, as shown in FIG. 6, the jib 2 is inclined sideways with respect to a center line of the boom 1 and therefore a most extent thereof from a base end to a forward end projects sideways when viewed from above.

The jib 2 has an engaging pin 7 at a base end portion thereof mounted on an upper face of a main beam 2*a* projecting sideways of the boom 1 in the folded state (a lower face of the main beams 2*a* in a stretched state).

On the other hand, a jib maneuvering cylinder 6 is mounted to a left side surface of the fixed boom 1*a* at a forward end portion thereof and extends in a direction normal to the center line of the boom 1, so that cylinder 6 can be positioned right above the engaging pin 7 when the jib 2 is in the folded state. An engaging hole 64 formed at a forward end 63 of a rod 62 provided in the cylinder 6 is engageable with a forward end 71 of the engaging pin 7 when the jib 2 is in the folded state as shown in FIGS. 5 and 6 and in the suspended position as shown in solid lines in FIG. 7.

Hereafter, there will be described a jib stretching operation in the second embodiment. It should be appreciated that the connecting member 4 described in connection with the first embodiment is not used in the jib down-folding type crane.

(1) A movable boom 1*b* is completely contracted and jib feet 21, 21 are engaged with jib mounting shafts 11, 11 provided on opposite side faces of a forward end of the movable boom 1*b*.

In this state, only the left jib foot 21 is connected to the left jib mounting shaft 11 with an unillustrated connecting pin and the right jib foot 21 is merely kept engaged with the right jib mounting shaft 11.

(2) The boom 1 is pivotally moved up to a maximum angled position thereof where the angle formed between the boom 1 and the ground surface is at maximum after the fixation of the jib 2 to the boom 1 by means of the jib fixing mechanism 5 is released. Thereafter, the jib maneuvering cylinder 6 is caused to extend to bring the jib 2 to the suspended position.

(3) Subsequently, the movable boom 1*b* is extended slightly to pull up the jib 2, and thereby the engaging pin 7 is disengaged from the engaging hole 64. After the boom 1 is pivotally moved downward as shown in phantom lines in FIG. 7, the jib 2 is swung up to be stretched out forwardly from a forward end of the boom 1.

The jib swinging-up step is carried out in the following manner. An auxiliary hook connected to a free end of an unillustrated auxiliary hoist wire rope is fixed to the forward end of the jib 2 with the jib 2 in the state shown in phantom lines in FIG. 7. Then, the jib 2 is swung up by winding up the wire rope.

In the jib swinging-up step, a pulling force works from the forward end of the jib 2 toward the boom 1. Upon subjected to this pulling force, the inclined posture of the jib 2 with respect to the center line of the boom 1 is corrected to a specified balanced stretched posture thereof.

The jib 2 is returned from its stretched position to its folded position along the lower surface of the boom 1 in the reverse order of the above jib stretching operation. However, in the jib returning operation, there is no need to disengage the engaging pin 7 from the engaging hole 64 in step (3). Accordingly, the jib returning operation may be carried out with the movable boom 1*b* completed contracted.

The present invention is not limited to the foregoing embodiment, but also can be embodied as follows.

(1) In the foregoing embodiments, the engaging pin 7 is inserted into the engaging hole 64 in the direction leading from the base end portion of the jib 2 to the forward end portion thereof. Conversely, the engaging pin 7 may be inserted into the engaging hole 64 in the opposite direction, i.e., in a direction leading from the forward end portion of the jib 2 to the base end portion thereof. In this case, after the jib 2 is swung down from its folded position to its vertically suspended position in the jib stretching operation, the pin 7 is disengaged from the hole 64 in steps reverse of the foregoing embodiments. Specifically, the jib 2 may be swung down with the boom 1 being slightly extended beforehand. Then, the boom 1 is contracted.

(2) In the foregoing embodiments, the forward end portion 63 of the rod 62 included in the jib maneuvering cylinder 6 and the forward end portion 71 of the engaging pin 7 are both provided with the respective oblique guide surfaces 65, 72. However, it may be appropriate that the oblique guide surface be provided at either one of the forward ends 63 and 71.

(3) In the first embodiment, the main beam 2*a* is provided with the connecting member 4, and the jib 2 is swung down from its folded position to its vertically suspended position about the jib mounting shaft 11 with the connecting member 4 is engageably connected to one of the jib mounting shafts 11 and the connection point serving as a supporting point. However, the jib 2 may not be provided with the connecting member 4. Instead, one of the jib feet 21 is connected to the jib mounting shaft 11, and the jib 2 is swung down to the vertically suspended position about the jib mounting shaft 11 using the connection point as a supporting point.

As described above, according to the present invention, in a jib side-folding type crane and a jib down-folding type crane, a boom is provided with a jib maneuvering cylinder and a jib is provided with an engaging member. The jib maneuvering cylinder includes an extendible actuating member having an engaging portion. The jib is made movable between a folded position and a vertically suspended position in a jib stretching operation and a jib folding operation with the engaging portion and the engaging member being engageably connected to each other by way of extension and contraction of the extendible actuating member. Accordingly, there is eliminated the need for time-consuming and cumbersome operations indispensable in the case where a conventional auxiliary hoist wire rope is used in a jib swinging-down and hauling steps, such as reeving of the rope, engagement and disengagement of an auxiliary hook with and from a free end of the rope, handling of the rope after the jib stretching operation and the jib folding operation. Therefore, the jib swinging-down operation and the jib hauling operation can be executed easily and rapidly by way of extension and contraction of the remotely controlled cylinder.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A jib stretching and folding device for use in a crane including:

a telescopic boom having a forward end portion:

a jib having a base end portion, the base end portion of the jib being connected to a forward end portion of the boom, the jib being movable between a stretched position where the jib is stretched out from the forward end portion of the boom and a folded position along a lower surface of the boom through an intermediate step of putting the jib into a vertically suspended position about a connection point of the base end portion of the jib and the forward end portion of the boom;

the jib stretching and folding device comprising:

(I) a jib maneuvering cylinder having an extendible actuating member, the cylinder being mounted on the boom in such a manner that the extendible actuating member projects outward from the lower surface of the boom when the extendible actuating member is extended;

(II) an engaging portion provided in the extendible actuating member of the jib maneuvering cylinder;

(III) an engaging member mounted to the jib so as to selectively engage with the engaging portion by movement of the engaging member in a lengthwise direction of the jib;

(IV) a guide surface formed in at least one of the engaging member and the engaging portion for guiding the engaging member in the lengthwise direction of the jib so as to engage with the engaging portion when the jib is in the vertically suspended position and the jib maneuvering cylinder is in an extended state in a jib folding operation.

2. A jib stretching and folding device as defined in claim 1 wherein the jib maneuvering cylinder includes a rod and a tube, and is mounted on a side surface of the boom in such a direction that when the boom extends horizontally, the tube is positioned above the rod whereby the rod comprises the extendible actuating member.

3. A jib stretching and folding device as defined in claim 2 wherein the engaging portion defines an engaging hole, an axis of the engaging hole being perpendicular to an axis of the cylinder, and wherein the engaging member includes an engaging pin disposed on the jib and biased in such a direction as to engage with the engaging hole.

4. A jib stretching and folding device as defined in claim 1 wherein the engaging portion defines an engaging hole, an axis of the engaging hole being perpendicular to an axis of the cylinder, and wherein the engaging member includes an engaging pin disposed on the jib and biased in such a direction as to engage with the engaging hole.

5. A jib stretching and folding device as defined in any one of claims 1 to 3 wherein the engaging member is so disposed on the jib as to engage with the engaging portion by movement in a direction leading from the base end of the jib to the forward end thereof.

* * * * *